US007336024B2

(12) United States Patent
Yoshimoto et al.

(10) Patent No.: US 7,336,024 B2
(45) Date of Patent: Feb. 26, 2008

(54) SPARK PLUG

(75) Inventors: Osamu Yoshimoto, Nagoya (JP); Yoshihiro Matsubara, Yokkaichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/316,713

(22) Filed: Dec. 27, 2005

(65) Prior Publication Data

US 2006/0152129 A1 Jul. 13, 2006

(30) Foreign Application Priority Data

Dec. 28, 2004 (JP) ..... 2004-381527

(51) Int. Cl.
*H01T 13/39* (2006.01)

(52) U.S. Cl. ..... 313/141; 313/118

(58) Field of Classification Search ..... 313/118–145
See application file for complete search history.

(56) References Cited

U.S. PATENT DOCUMENTS 5,406,166 A * 4/1995 Abe et al. ..... 313/142
6,078,129 A * 6/2000 Gotou et al. ..... 313/141
6,215,234 B1 * 4/2001 Abe et al. ..... 313/141
2001/0013746 A1 * 8/2001 Kanao et al. ..... 313/144
2002/0063504 A1 * 5/2002 Hori ..... 313/141
2002/0067111 A1 * 6/2002 Shibata et al. ..... 313/141
2003/0038575 A1 * 2/2003 Hori et al. ..... 313/141
2004/0140745 A1 7/2004 Hrastnik

FOREIGN PATENT DOCUMENTS

JP 58-26480 2/1983
JP 58-34151 2/1983
JP 58-198886 11/1983
JP 61-44141 3/1986

* cited by examiner

*Primary Examiner*—Nimeshkumar D. Patel
*Assistant Examiner*—Christopher M. Raabe
(74) *Attorney, Agent, or Firm*—Sughrue Mion, PLLC

(57) ABSTRACT

A spark plug including a noble metal tip bonded to at least one of a front-end portion of a center electrode and an end portion of the ground electrode opposing the center electrode. The noble metal tip contains from 5 to 40 wt % of Rh; from 1 to 20 wt % of at least one of Ir, Re and Ru; from 0.2 to 3 wt % of Ni; and 37 wt % or more of Pt.

9 Claims, 3 Drawing Sheets

SPARK PLUG

BACKGROUND OF THE INVENTION

1. Field of the Invention

The present invention relates to a spark plug for an internal-combustion engine in which a noble metal tip is joined to an electrode which undergoes spark discharge.

2. Description of the Related Art

Conventionally, a spark plug has been used for ignition of an internal-combustion engine. A commonly-used spark plug includes a metal shell surrounding and holding an insulator therein, to which a center electrode is inserted in an axial hole, and a ground electrode, one end of which is welded to a front end of the metal shell and the other end of which is opposed to a front end of the center electrode so as to form a spark discharge gap. In the spark discharge gap, opposing surfaces between the center electrode and the ground electrode are provided with noble metal tips for improving spark consumption resistance.

As a material for the noble metal tip, conventionally, a Pt alloy is used which has a high melting point, excellent heat resistance and good oxidation resistance. In the noble metal tip made from the Pt alloy, consumption of the electrode caused by the spark discharge is less than that of an electrode tip made from a base metal such as a Ni alloy. Consequently good ignition performance can be maintained for a long period of time, and therefore the durable life is good. However, when the noble metal tip made from a Pt alloy is used in the corrosive atmosphere of an internal-combustion engine, if grain growth proceeds at a surface layer portion thereof, crystal grains may peel (drop) off due to cracks formed at the grain boundaries.

In order to suppress grain growth, the addition of Ir is known to be effective. However, Ir tends to volatilize by forming an oxide when subjected to high temperature. A noble metal tip having high durability has been proposed, in which a noble metal which is hardly oxidized and volatilized such as Rh is included in a Pt—Ir alloy to suppress the oxidation and volatilization of Ir, while grain growth of Pt is suppressed by the presence of Ir (see for example, JP-B-61-30014).

3. Problems to be Solved by the Invention

However, in recent years, high output technology of the internal-combustion engine has progressed. As a result, the temperature in the combustion chamber of an internal-combustion engine in which the spark plug is used has become higher than in the past. Although Pt has a high melting point, excellent heat resistance and good oxidation resistance, there is a concern relating to oxidation at today's higher temperatures. On the other hand, there is an additional concern that when Ir is volatized to generate many fine gaps on a surface layer portion, the noble metal tip becomes fragile. In order to increase the durability of the noble metal tip, an increase in Rh content might be contemplated. However, when the Rh content is increased, grain growth of the noble metal tip is thereby promoted which tends to form cracks in the grain boundaries.

This invention has been made for solving the above problems, and an object thereof is to provide a spark plug having a noble metal tip, which can improve durability even when used in a high temperature environment.

SUMMARY OF THE INVENTION

The above object has been achieved, in a first aspect of the invention, by providing a spark plug comprising a center electrode, an insulator having an axial hole extending in an axial direction of the center electrode, holding the center electrode inside the axial hole, a metal shell surrounding the insulator to hold the insulator therein, a ground electrode including a first end portion bonded to the metal shell and a second end portion opposed to the center electrode and a noble metal tip connected to at least one of a front-end portion of the center electrode and the second end portion of the ground electrode, wherein the noble metal tip has an Rh content of 5 wt % or more and 40 wt % or less, an "X" content of 1 wt % or more and 20 wt % or less where "X" is one or a combination of two or more selected from the group consisting of Ir, Re and Ru, an Ni content of 0.2 wt % or more and 3 wt % or less, and a Pt content of 37 wt % or more.

In a second aspect of the invention, the Rh content of the noble metal tip is 10 wr % or more and 30 wt % or less, in the structure of the first aspect.

In a third aspect of the invention, the Rh content is 20 wt % or less, in the structure of the second aspect.

In a fourth aspect of the invention, "X" comprises Ir, and the content thereof is 5 wt % or more and 20 wt % or less, in the structure of the first aspect.

In a fifth aspect of the invention, the Ir content is 8 wt % or less, in the structure of the fourth aspect.

In a sixth aspect of the invention, the Ni content of the noble metal tip is 0.5 wt % or more and 2 wt % or less, in the structure of the first aspect.

In a seventh aspect of the invention, the Ni content is 1.5 wt % or more, in the structure of the sixth aspect.

In an eighth aspect of the invention, the noble metal tip further contains a rare earth oxide, in the structure of any of the first to seventh aspects.

In the spark plug according to the first aspect, as to the composition of the noble metal chip, the Rh content thereof is 5 wt % or more and 40 wt % or less, the content of "X" which is one or a combination of two or more selected from Ir, Re and Ru is 1 wt % or more and 20 wt % or less, the Ni content is 0.2 wt % or more and 3 wt % or less and the Pt content is 37 wt % or more. With such composition, the durability of the noble metal tip when subjected to spark discharge in a high temperature environment can be increased. Namely, addition of "X" is effective for suppressing grain growth of Pt, and addition of Rh is effective for preventing oxidation and volatilization of "X". Ni is added for suppressing corrosion of "X" or Rh in the alloy containing Pt, Rh, "X" and the like, with an object of improving weldability to the ground electrode. These effects can be realized because the noble metal tip is formed from the above composition.

When the Rh content of the noble metal tip is less than 5 wt %, the oxidation and volatilization of "X" can not be sufficiently suppressed. A Rh content exceeding 40 wt % improves oxidation resistance of the noble metal tip, but also promotes grain growth at the surface layer of the noble metal tip. As a result, crystal grains present at the surface of the noble metal tip may peel (drop) off due to cracks formed at the grain boundaries.

When the "X" content of the noble metal tip is less than 1 wt %, it is difficult to suppress grain growth at the surface of the noble metal tip, and crystal grains present at the surface of the noble metal tip may peel (drop) off due to cracks formed at the grain boundaries. On the other hand, if the "X" content exceeds 20 wt %, the amount of "X" which is oxidized and volatilized at high temperature may increase.

When many fine gaps are generated at the surface layer portion of the noble metal tip by the oxidation and volatilization of "X", durability of the noble metal tip decreases.

Furthermore, when, the Ni content of the noble metal tip is less than 0.2 wt % sufficient weldability can not be obtained when welding to the ground electrode or the center electrode. On the other hand, when too much Ni is added, the hardness of the Pt—Rh—X—Ni alloy becomes excessively high, workability decreases and the yield decreases. Therefore the Ni content preferably does not exceed 3 wt %. By adding Ni, an effect of increasing corrosion resistance of the oxide layer formed at the surface of the alloy can be obtained.

In the invention according to the second aspect, the Rh content is preferably 10 wt % or more and 30 wt % or less. In this manner, the oxidation and volatilization of "X" can be prevented further effectively, oxidation resistance of the noble metal tip can be improved and grain growth can be suppressed further effectively.

In the invention according to the third aspect, the Rh content is preferably 20 wt % or less because better suppression of grain growth in the noble metal tip is expected.

In the invention according to the fourth aspect, when "X" is Ir, and the Ir content is 5 wt % or more and 20 wt % or less, sufficient spark consumption resistance can be obtained and grain growth at the surface layer of the noble metal tip can be effectively suppressed. That is, because Ir has excellent oxidation resistance at high temperatures as compared with Re or Ru, addition of Ir as "X" within the above range will be further effective.

In the invention according to the fifth aspect, when the Ir content is 8 wt % or less to reduce the tendency of oxidation and volatilization, oxidation resistance preferably can be further improved while maintaining the effect of suppressing growth at the surface layer of the noble metal tip.

In the invention according to the sixth aspect, when the Ni content is 0.5 wt % or more and 2 wt % or less, weldability and spark consumption resistance of the noble metal tip can be increased further effectively without reducing workability. As described above, the addition of Ni suppresses peeling of the oxide layer and improves weldability to the ground electrode. However, workability tends to decrease because the hardness of the alloy itself is increased. On the other hand, restricting the addition of Ni which has a lower melting point than the noble metal is expected to effectively suppress lowering of the spark consumption resistance. In order to suppress the peeling of the oxide layer and to more suitably secure weldability to the ground electrode, and further, so as not to reduce workability of the noble metal tip even if spark consumption resistance is improved, the Ni content is effective with a range of 0.5 wt % or more and 2 wt % or less.

Thus, when the Ni content is 2 wt % or less, workability is not reduced. In this state, in the invention according to the seventh aspect, the Ni content is preferably set to 1.5 wt % or more because weldability of the noble metal tip can be increased further effectively.

In the spark plug of the eighth aspect, in addition to the effect of the invention according to any one of the first to seventh aspects, spark consumption resistance can be increased by adding a rare earth oxide, for example, $Y_2O_3$ and/or $La_2O_3$, to the noble metal tip.

DESCRIPTION OF REFERENCE NUMERALS

Figure 1:
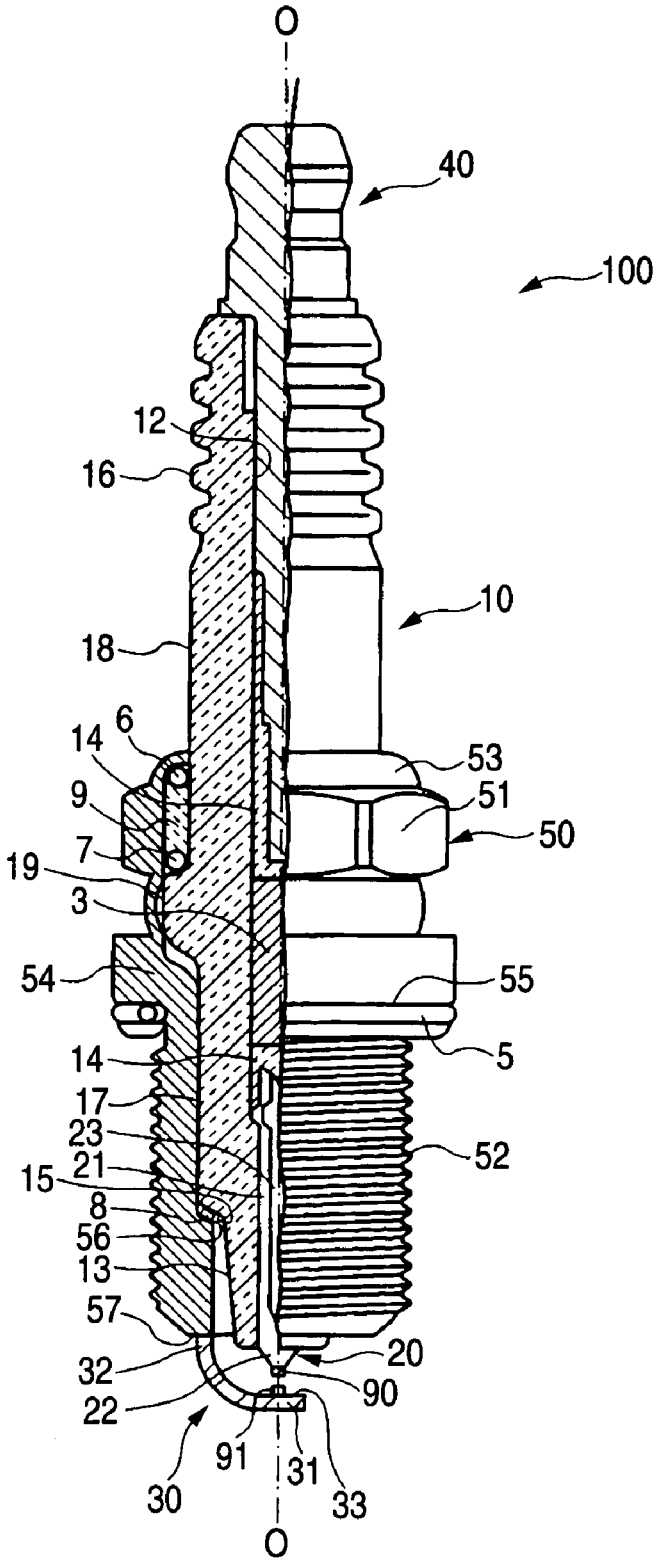
FIG. 1 is a partial cross-sectional view of a spark plug 100.

Reference numerals used to identify various structural features in the drawings include the following.

10 insulator
12 axial hole
20 center electrode
30 ground electrode
31 front-end portion
32 base portion
40 terminal metal shell
90, 91 noble metal tip
100 spark plug

DETAILED DESCRIPTION OF THE INVENTION

Hereinafter, an embodiment of a spark plug embodying the invention will be explained with reference to the drawings. However, the invention should not be construed as being limited thereto. First, referring to FIG. 1, a structure of a spark plug 100 of the embodiment will be explained. FIG. 1 is a partial cross-sectional view of the spark plug 100. The explanation will be made regarding a side at which a center electrode 20 is held in an axial hole 12 of an insulator 10 in an axis "O" direction as a front-end side of the spark plug 100.

As shown in FIG. 1, the spark plug 100 includes, roughly, the insulator 10, a metal shell 50 provided at an almost central part in a longitudinal direction of the insulator 10, which holds the insulator 10, the center electrode 20 being held in an axial direction in the axial hole 12 of the insulator 10, a ground electrode 30 having a first end (base portion 32) welded to a front-end surface 57 of the metal shell 50 and a second end (front-end portion 31) opposed to a front-end portion 22 of the center electrode, and a terminal metal shell 40 provided at a back-end part of the center electrode 20.

Firstly, the insulator 10 forming an insulator of the spark plug 100 will be explained. The insulator 10 is a tubular insulating member including the axial hole 12 in the axis "O" direction, which is formed by firing alumina and the like as is commonly known. A flange portion 19 having the largest diameter is formed almost at the center in the axis "O" direction and a back-end side body portion 18 is formed at the back-end side therefrom. A corrugation portion 16 for provivding a creepage distance is formed further near to the back-end from the back-end side body portion 18. A front-end side body portion 17 having a smaller outer diameter than the back-end side body portion 18 is formed near to the front-end side from the flange portion 19. A long leg portion 13 having a smaller outer diameter than the front-end side body portion 17 is formed further near to the front-end side from the front-end side body portion 17. The diameter of the long leg portion 13 gradually becomes smaller toward the front-end side, and the leg portion 13 is exposed in the combustion chamber when the spark plug 100 is assembled in an internal-combustion engine (not shown).

Next, the center electrode 20 will be explained. The center electrode 20 is a rod-shaped electrode in which a core material 23 made from copper, copper alloys or the like for promoting radiation is embedded in the central part of an electrode base material 21 made from nickel alloys and the like such as INCONEL (trade name) 600 or 601. The front-end portion 22 of the center electrode 20 protrudes from the front-end surface of the insulator 10, formed to be smaller in diameter toward the front-end side. At a front-end surface of the front-end portion 22, a columnar noble metal tip 90 is welded by resistance welding so that the column axis corresponds to the axis of the center electrode 20. The center electrode 20 is also connected to the upper terminal metal shell 40 electrically through a sealing body 14 and a ceramic resistor 3 provided inside the axis hole 12. A high-pressure cable (not shown) is connected to the terminal metal shell 40 through a plug cap (not shown), to which high voltage is applied.

Next, the metal shell 50 will be explained. The metal shell 50 holds the insulator 10 to fix the spark plug 100 to the internal-combustion engine (now shown). The metal shell 50 holds the insulator 10 so as to surround the insulator 10 from the back-end side body portion 18 in the vicinity of the flange portion 19 to the flange portion 19, the front-end side body portion 17 and the long leg portion 13. The metal shell 50 is made from a low-carbon steel material and includes a tool engagement portion 51 to which a spark plug wrench (not shown) is fit, and a screw portion 52 which screws to an engine head provided at an upper part of the internal-combustion engine (not shown).

Annular ring-members 6, 7 are interposed between the tool engagement portion 51 of the metal shell 50 and the back-end side body portion 18 of the insulator 10. Further, talc powder talc 9 is filled between both ring members 6, 7. A crimping portion 53 is formed at the back-end side of the tool engagement portion 51, and the insulator 10 is pushed toward the front-end side in the metal shell 50 through the ring members 6, 7 and the talc 9 by crimping the crimping portion 53. Thus, a step portion 15 between the front-end side body portion 17 and the long leg portion 13 is supported by a step portion 56 formed in the inner periphery of the metal shell 50 through a plate packing 8. As a result, the metal shell 50 and the insulator 10 are united. Airtightness between the metal shell and the insulator 10 is maintained by the packing 8, which prevents combustion gas from flowing out. A flange portion 54 is formed at the central part of the metal shell 50, and a gasket 5 is inserted and fitted in the vicinity of the back-end side of the screw portion 52 (upper part in FIG. 1), that is, on a seat surface 55 of the flange portion 54.

Next, the ground electrode 30 will be explained. The ground electrode 30 is made from a metal having a high corrosion resistance. As one example, a nickel alloy such as INCONEL (trade name) 600 or 601 is used. The ground electrode 30 has an almost rectangular cross-section in its longitudinal direction, and the base portion 32 is welded to the front-end surface 57 of the metal shell 50. The front-end portion 31 of the ground electrode 30 is bent so as to be opposed to the front-end portion 22 of the center electrode 20. An inner surface 33 of the ground electrode 30 as a surface of the side facing the center electrode 20 is almost orthogonal to the axial direction of the center electrode 20. At the inner surface 33, a columnar noble metal tip 91 similar to the noble metal tip 90 of the center electrode 20 is welded, for example, by resistance welding, and a spark discharge gap is formed between the noble metal tip 91 and the noble metal tip 90.

The material of the noble metal tips 90, 91 in this embodiment is a Pt—Rh—X—Ni alloy, which includes Pt (platinum) as a major component, Rh (rhodium) in an amount of 5 wt % or more and 40 wt % or less, "X" in an amount of 1 wt % or more and 20 wt % or less (as used herein, "X" means one or a combination of two or more selected from Ir, Re and Ru) and Ni in an amount of 0.2 wt % or more and 3 wt % or less.

Pt has a high melting point of 1772° C., excellent heat resistance, and its oxidation resistance is also good. It is possible to suppress grain growth of Pt by adding Ir, for example, as "X". Ir has a higher melting point than Pt and has excellent heat resistance. Therefore, spark consumption resistance of a Pr—Ir alloy is good. Further, it is possible to suppress oxidation and volatilization of Ir by adding Rh to the Pt—Ir alloy. Rh can suppress oxidation of Ir in a high temperature region further effectively. When a small amount of Ni is added to the Rh—Ni alloy, weldability can be improved. Corrosion resistance of an oxide layer formed on a surface of the alloy can be increased by adding Ni.

However, the above effect is not achieved only by adding the above Pt, Rh, Ir and Ni as components of the noble metal tips 90, 91, and it is important to add them impartibly (i.e., without separation) at a specific component rate. When the Rh content of the noble metal tips 90, 91 is 5 wt % or more and 40 wt % or less, the oxidation and volatilization of Ir is effectively prevented. If the Rh content is less than 5 wt %, the oxidation and volatilization of Ir cannot be sufficiently suppressed. As a result, oxidation resistance of the noble metal tips 90, 91 is decreased. If the Rh content is more than 40 wt %, oxidation resistance of the noble metal tips 90, 91 is improved. However, grain growth of the noble metal tips 90, 91 at a surface layer thereof is promoted, and crystal grains at the surface of the noble metal tips 90, 91 may peel (drop) off due to cracks formed in grain boundaries. The results of an evaluation test discussed below show that the effect of the embodiment is more preferably achieved when the Rh content is 10 wt % or more and 30 wt % or less in the Pt—Rh—Ir—Ni alloy.

The results of the evaluation test also show that a further effect of suppressing grain growth can be obtained while maintaining the preventative effect for the oxidation and volatilization of Ir when the Rh content is 20 wt % or less. If focusing attention on the suppression effect of grain growth, a lower Rh content is preferred. The suppression effect of grain growth can be more preferably obtained when the Rh content is 10 wt % or less.

When the Ir content is 1 wt % or more and 20 wt % or less, grain growth at the surface layer of the noble metal tips 90, 91 can be suppressed and the oxidation resistance can also be increased. When the Ir content of the noble metal tips 90, 91 is less than 1 wt %, it is difficult to suppress grain growth at the surface layer of the noble metal tips 90, 91. Therefore the crystal grains of the noble metal tips 90, 91 at the surface may peel (drop) off due to by cracks formed in the grain boundaries. On the other hand, when the Ir content exceeds 20 wt % the amount of Ir which is oxidized and volatilized at high temperature is increased. Namely, the oxidation resistance decreases. When many fine gaps are generated on the surface layer portion of the noble metal tips 90, 91 by the oxidation and volatilization of Ir, durability of the noble metal tips 90, 91 decreases. When the Ir content is 5 wt % or more and 20 wt % or less in the Pt—Rh—Ir—Ni alloy, the results of the evaluation test show there is an improvement in spark consumption resistance and in achieving the effect of the embodiment.

Furthermore, the results of the evaluation test show that when the Ir content is 8 wt % or less, the tendenxy for Ir to become oxidized and volatilized at high temperature so as to decrease durability of the noble metal tips 90, 91 may be further reduced. At the same time, the effect of suppressing grain growth at the surface layer of the noble metal tip can be maintained without being lowered. As a result, the oxidation resistance can be further improved.

Next, when the Ni content is 0.2 wt % or more and 3 wt % or less, weldability and workability of the noble metal tips 90, 91 can be effectively increased. When the Ni content is less than 2 wt %, sufficient weldability cannot be obtained when welding to the ground electrode 30 or the center electrode 20. If the Ni content is more than 3 wt %, the Pt—Rh—Ir—Ni alloy becomes hard and workability is decreased. Further, when the Ni content is 0.5 wt % or more and 2 wt % or less, the results of the evaluation test show that the spark consumption resistance is also improved and the effect of the embodiment is more readily achieved. It is also possible that corrosion resistance of the oxide layer formed at the surface of the alloy is increased by adding Ni.

Referring to the results of the evaluation test, when the Ni content is 1.5 wt % or more and is 2 wt % or less, workability is not appreciably lowered. This is preferable because weldablility of the noble metal tips 90, 91 to either of the center electrode 20 or the ground electrode 30 can be further improved.

EXAMPLES

Example 1

An evaluation test was performed in order to confirm the effectiveness of the invention with respect to oxidation resistance, spark consumption resistance, weldability, degree of grain growth and workability by specifying the contents of respective components in the Pt—Rh—X—Ni alloy as a material of the noble metal tip. All proportions are given in wt % unless otherwise specified.

In the evaluation test, first, as shown in Table 1, a noble metal tip having a diameter of ϕ0.7 mm was fabricated as a sample using 30 kinds of Pt—Rh—X—Ni alloy materials of varying composition. Regarding the height of the noble metal tip, a noble metal tip of 0.9 mm was used in an evaluation test for spark consumption resistance, and noble metal tips of 0.3 mm were used for other evaluation tests.

Sample No. 1 did not contain Ni, and the composition thereof was Pt-20Rh-10Ir. Sample No. 2 did not contain "X" (one or a combination of two or more of Ir, Re and Ru), and the composition thereof was Pt-20Rh-1Ni. Sample Nos. 3 to 5 were made by including one component in addition to Pt, and the compositions thereof were Pt-20Rh, Pt-20Ir and Pt-20Ni, respectively.

Sample Nos. 6 to 10, 12, and 14 were samples for comparison in which the Rh contents were varied. The respective compositions were Pt-45Rh-10Ir-1Ni, Pt-40Rh-10Ir-1Ni, Pt-30Rh-10Ir-1Ni, Pt-20Rh-10Ir-1Ni, Pt-10Rh-10Ir-1Ni, Pt-5Rh-10Ir-1Ni and Pt-3Rh-10Ir-1Ni.

Sample Nos. 11 to 13, 17, 18, 21 and 22 were samples for comparison in which the Ir contents were varied. In Sample Nos. 11 to 13, the Rh content was 5 wt %, and in Sample Nos. 17, 18, 21 and 22, the Rh content was 20 wt %, and a comparison was made by fabricating the respective samples to have a different Ir content. The compositions of Sample Nos. 11, 13, 17, 18, 21 and 22 were Pt-5Rh-8Ir-1Ni, Pt-5Rh-20Ir-1Ni, Pt-20Rh-1Ir-1Ni, Pt-20Rh-5Ir-1Ni, Pt-20Rh-20Ir-1Ni and Pt-20Rh-25Ir-1Ni, respectively.

Sample Nos. 15, 16 and Sample Nos. 1.9 and 20, where "X" is Re or Ru, were samples for comparison to Sample Nos. 17 and 18, respectively using Ir as "X". The resepctive compositions were Pt-20Rh-1Re-1Ni, Pt-20Rh-1Ru-1Ni, Pt-20Rh-5Re-1Ni and Pt-20Rh-5Ru-1Ni.

Sample Nos. 23 to 28 were samples for comparison in which the Ni content was varied. The respective compositions were Pt-20Rh-10Ir-0.2Ni, Pt-20Rh-10Ir-0.5Ni, Pt-20Rh-10Ir-1.5Ni, Pt-20Rh-10Ir-2Ni, Pt-20Rh-10Ir-3Ni, and Pt-20Rh-10Ir-3.5Ni.

Next, Sample Nos. 29 and No. 30 were samples in which a rare earth oxide was further added to the Pt—Rh—X—Ni alloy, and the respective compositions were Pt-20Rh-10Ir-1Ni-1.5$Y_2O_3$ and Pt-20Rh-10Ir-1Ni-1.5$La_2O_3$.

Sample Nos. 31 to 33 were compared with Sample No. 9, in which two kinds of elements were included as "X" where the total "X" content was not changed. The respective compositions were Pt-20Rh-5Ir-5Re-1Ni, Pt-20Rh-5Ir-5Ru-1Ni and Pt-20Rh-5Ru-5Re-1Ni. Sample No. 34 was compared with the Sample No. 9 by making "X" Re, and the composition thereof was Pt-20Rh-10Re-1Ni.

The respective samples were evaluated with respect to oxidation resistance, spark consumption resistance, weldability, degree of grain growth and workability following the procedures described below.

Figure 2:
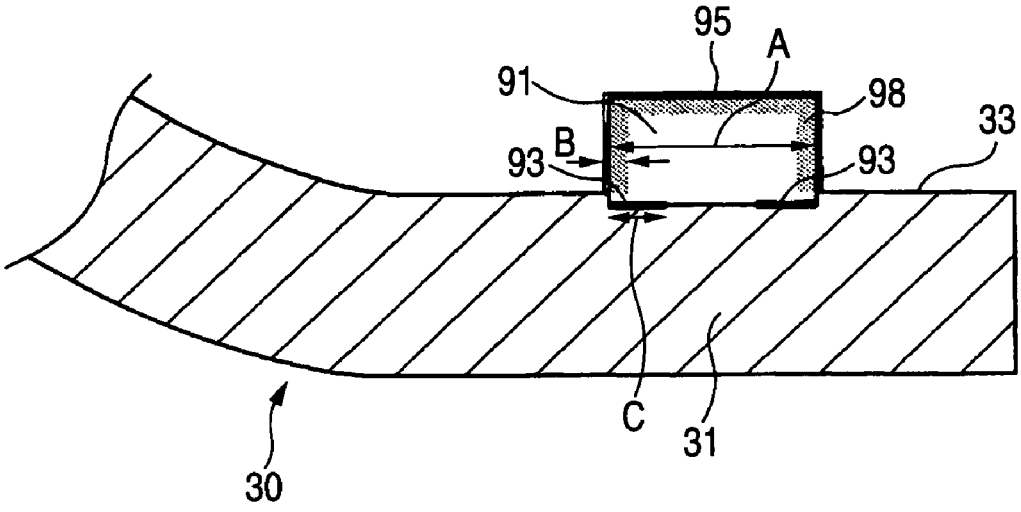
FIG. 2 is a view showing an example for explaining methods for evaluation of oxidation resistance and weldability.

In the evaluation for oxidation resistance, the respective samples were heated in an electric furnace in an air atmosphere at 1100° C. for 30 hours. After the heat treatment, the respective samples were cut at a cross section passing through a column axis and the cut surface was observed with a magnifying glass. As illustrated in FIG. 2, a thickness "B" of a portion of the sectioned sample was measured, at a position where the total thickness of (i) the oxide layer 95 (formed at the surface of the noble metal 91) and (ii) a component portion 98 (in which fine gaps were formed by oxidation and volatilization of Ir in the components of the noble metal tip 91) would be at a maximum.

The thickness "B" was compared with an outer diameter A of the noble metal tip 91 and when a rate determined by "B/A×100 (%)" was less than 10%, the sample was evaluated as having a grade of "A" showing excellent oxidation resistance. Similarly, when the rate was 10% or more and 15% or less, the sample was evaluated as "B" showing good oxidation resistance. When the rate was 15% or more and 25% or less, the sample was evaluated as "C" showing rather good oxidation resistance. When the rate was 25% or more, the sample was evaluated as "F" and considered to exhibit poor oxidation resistance and durability.

As result of the evaluation test for oxidation resistance, Sample Nos. 1 to 3, 6 to 11, 15 to 21, and 23 to 34 were evaluated as having a grade of "A". Sample Nos. 12 and 13 were evaluated as "B", Sample No. 5 was evaluated as "C", and Sample Nos. 4, 14 and 22 were evaluated as "F".

Next, in the evaluation test for spark consumption resistance, spark plugs were fabricated using respective samples in which the noble metal tips were welded to each of the center electrode and the ground electrode. The size of the spark discharge gap was adjusted to 1.05 mm. Then, after subjecting the samples to a discharge voltage of 60 Hz and approximately 16 kV in an air atmosphere of 0.6 MPa for 100 hours, an increase in the amount of the spark discharge gap was measured for each of the spark plug samples.

An increase in the spark discharge gap of less than 0.1 mm was evaluated as having a grade of "B" showing good spark consumption resistance. An increase in the spark discharge gap of 0.1 mm or more and 0.2 mm or less was evaluated as "C" showing rather good consumption resistance, and an increase of 0.2 mm or more was evaluated as "F" showing inferior spark consumption resistance.

In the evaluation test of spark consumption resistance, Samples Nos. 1, 4, 6 to 14, 18, 21 to 26, and 29 to 34 were evaluated as having a grade of "B". Sample Nos. 3, 15 to 17, 19, 20, and 27 were evaluated as "C", and Sample Nos. 2, 5 and 28 were evaluated as "F".

Next, in the evaluation test for weldability as to the respective samples, the noble metal tip 91 welded to the ground electrode 30 by resistance welding as illustrated in FIG. 2 was heated by a burner, maintained at a temperature of 950° C. for two hours, and then cooled naturally (left in a room temperature) for one minute. Regarding the above process as one cycle, 1000 cycles were carried out for each sample. Then, the respective samples were cut together with the ground electrode 30 at the cross section passing through the column axis, and both welded surfaces were observed using a magnifying glass. In the welded surface, a length "C" of a portion 93 where peeling occurred in a direction orthogonal to the column axis of the noble metal tip 91 was measured. The measurement was performed for the maximum length in the cut surface where the peeling occurred.

The above length was compared with the outer diameter "A" of the noble metal tip 91 which was previously measured, and when a rate determined by "CA×100(%)" was less than 20%, the sample was evaluated as having a grade of "A" showing excellent weldability. Similarly, when the above rate was 20% or more and 30% or less, the sample was evaluated as "B" showing good weldability. When the rate was 30% or more and 50% or less, the sample was evaluated as "C" showing rather good weldability. When the rate was 50% or more, the sample was evaluated as "F" showing inferior weldability such that the noble metal tip was likely to peel off.

In the evaluation for weldability, Sample Nos. 25 to 28 were evaluated as having a grade of "A", Sample Nos. 4, 5, 7 to 14, 17 to 21, 24, and 29 to 34 were evaluated as "B", Sample Nos. 2, 3, 6, 15, 16, 22 and 23 were evaluated as "C", and Sample No. 1 was evaluated as "F".

Figure 3:
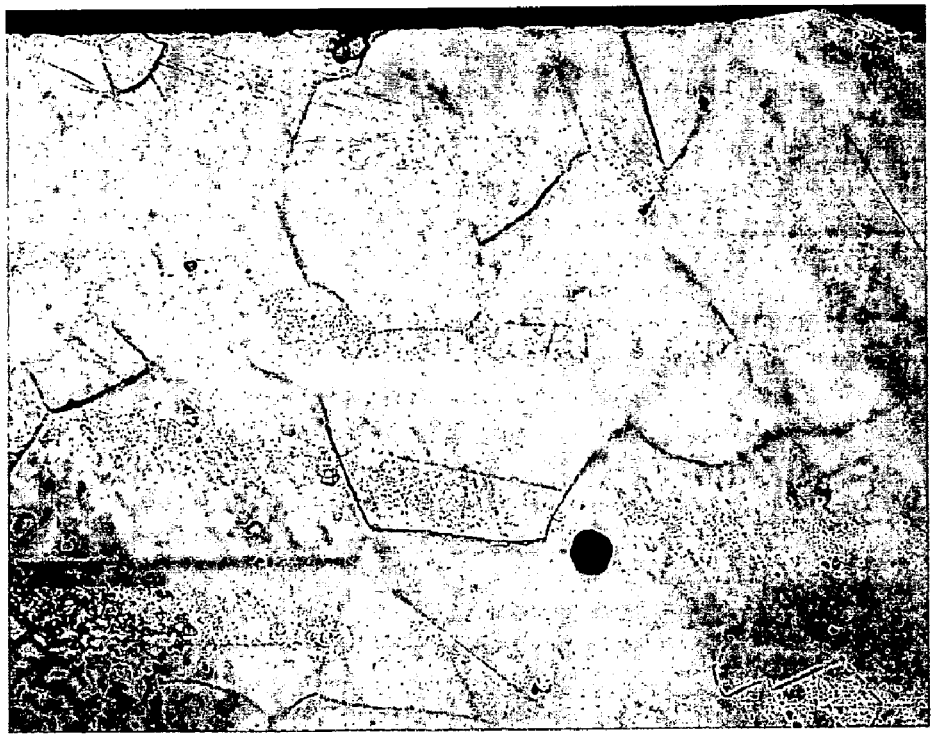
FIG. 3 is a surface photograph of a noble metal tip as a comparison example for confirming the degree of grain growth.
Figure 4:
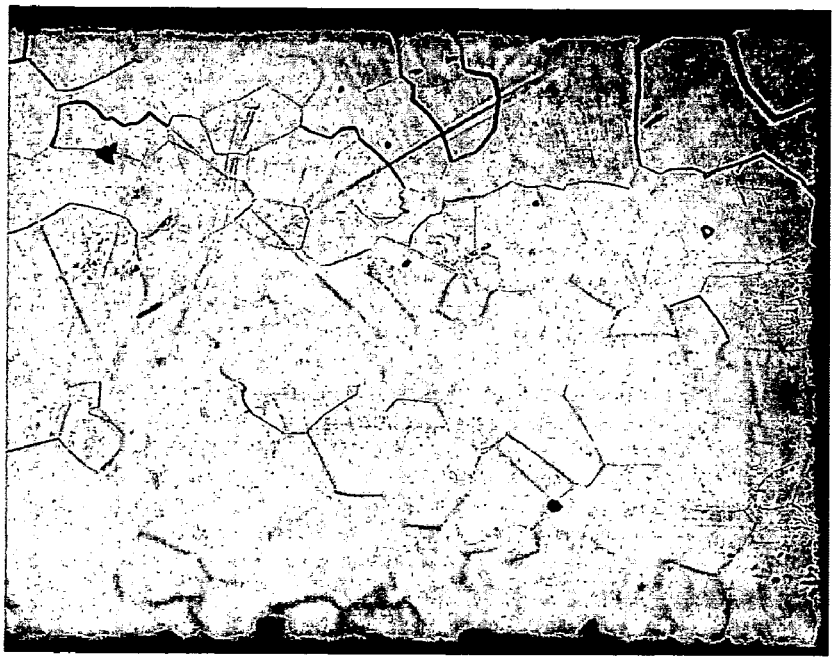
FIG. 4 is a surface photograph of a noble metal tip as a comparison example for confirming the degree of grain growth.
Figure 5:
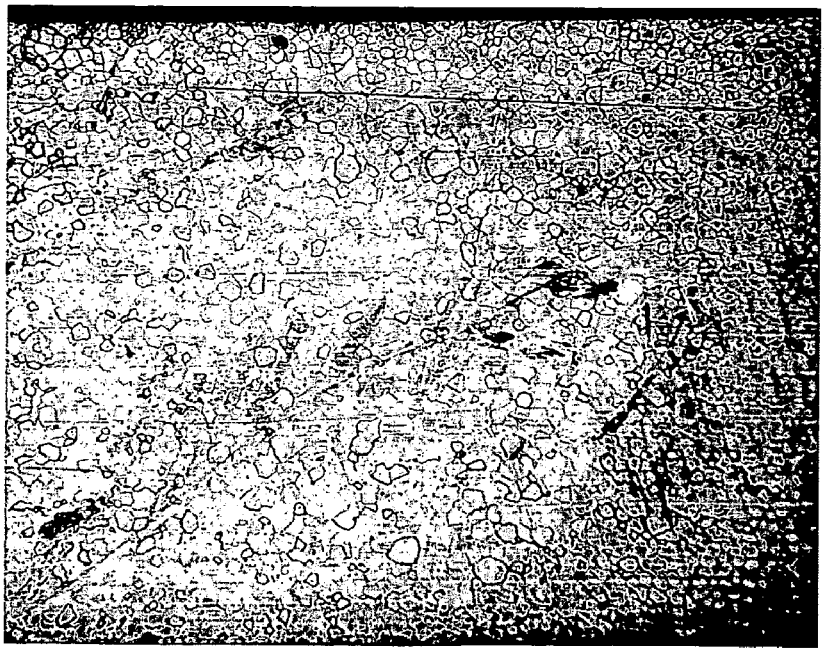
FIG. 5 is a surface photograph of a noble metal tip as a comparison example for confirming the degree of grain growth.

Next, in an evaluation test of the degree of grain growth, the respective samples were subjected to heat processing in a vacuum furnace at 100° C. for 20 hours. After that, the surfaces of respective samples were examined with a microscope of 50× magnification, and samples in which significant crystal grain growth was observed were evaluated as having a grade of "F". As for the evaluation criteria applied thereto, an example surface photograph of a sample evaluated as "F" is shown in FIG. 3. Those samples which exhibited the same or greater crystal grain growth were evaluated as "F". Those samples in which crystal grain growth was observed but where the growth was not as significant as compared with the "F" sample was evaluated as "C". Where the crystal grain size was smaller than shown in FIG. 3 and larger than the crystal grain size shown in FIG. 4, the sample was evaluated as "C". Those samples in which crystal grain growth was seldom seen were evaluated as "A", meeting a smaller crystal grain size than that of a surface photograph of the sample shown in FIG. 5. Further, those samples in which crystal grain growth to the extent of grade "C" was not reached but where some grain growth was observed were evaluated as "B". The evaluation of "B" was given for a crystal grain having the size seen on the surface photographs of FIG. 4 or FIG. 5, or a size therebetween.

In the evaluation test of the degree of grain growth, Sample Nos. 9 to 14 were evaluated as having a grade of "A". Sample Nos. 4, 5, 8 and 15 to 34 were evaluated as "B", Sample Nos. 1, 2 and 7 were evaluated as "C", and Sample Nos. 3 and 6 were evaluated as "F".

Next, in the evaluation test for workability, the yield rate (ratio of product that is not defective to all produced products) in a rolling process for fabricating the respective samples from thicker wires were determined. When the yield was 70% or more, the sample was evaluated as having a grade of "B" showing excellent workability. When the yield was 50% or more and 70% or less, the sample was evaluated as "C" showing good workability, and when the yield was less than 50%, the sample was evaluated as "F" which indicates that the material had poor workability.

In the evaluation test for workability, Sample Nos. 1 to 21, 23 to 25 and 29 to 34 were evaluated as "B". Sample Nos. 22, 26 and 27 were evaluated as "C", and a Sample No. 28 was evaluated as "F".

In the evaluation test for oxidation resistance, the noble metal tip 91 welded to the side of the ground electrode 30 is shown in FIG. 2, however, the same noble metal tip 90 was welded to the tip of the center electrode 20. When performing the evaluation test for oxidation resistance, it is not always necessary to weld the noble metal tip 91 to the ground electrode 30 as illustrated in FIG. 2, and the evaluation can be carried out using only the noble metal tip 90. Furthermore, it is not always necessary to perform the evaluation using a spark plug in the state of a completed product.

A comprehensive evaluation of the various tests was made by assigning a weight and totaling the results for the respective samples. The weighting was performed by assigning 3 points to those samples evaluated as having a grade of "A", 2 points when evaluated as "B", 1 point when evaluated as "C" and "0 (zero)" points when evaluated as "F". All points were added and totaled for each sample. A sample having a total of 11 or more points was evaluated as "A" showing extremely excellent quality, and a sample having a total of 10 points was evaluated as "B" showing good quality. When the total was 9 points, the sample was evaluated as "C" which indicates that it could be put to practical use, and when the total was 8 points or less, the sample was evaluated as "F" indicating poor performance is expected for use as a spark plug.

As a result of the comprehensive evaluation, Sample Nos. 8 to 13, 18, 21, 24 to 26 and 29 to 34 were evaluated as having a grade of "A". Sample Nos. 7, 17, 19, 20, 23 and 27 were evaluated as "B", Sample Nos. 14 to 16 were evaluated as "C", and Sample Nos. 1 to 6, 22 and 28 were evaluated as "F".

TABLE 1

| sample | Composition | Oxidation Resistance | Spark Consumption Resistance | Welda-bility | Grain Grown | Work-ability | Compre-hensive evaluation |
|---|---|---|---|---|---|---|---|
| 1 | Pt—20Rh—10Ir | A | B | F | C | B | F |
| 2 | Pt—20Rh—1Ni | A | F | C | C | B | F |
| 3 | Pt—20Rh | A | C | C | F | B | F |
| 4 | Pt—20Ir | F | B | B | B | B | F |
| 5 | Pt—20Ni | C | F | B | B | B | F |
| 6 | Pt—45Rh—10Ir—1Ni | A | B | C | F | B | F |
| 7 | Pt—40Rh—10Ir—1Ni | A | B | B | C | B | B |
| 8 | Pt—30Rh—10Ir—1Ni | A | B | B | B | B | A |
| 9 | Pt—20Rh—10Ir—1Ni | A | B | B | A | B | A |
| 10 | Pt—10Rh—10Ir—1Ni | A | B | B | A | B | A |
| 11 | Pt—5Rh—8Ir—1Ni | A | B | B | A | B | A |
| 12 | Pt—5Rh—10Ir—1Ni | B | B | B | A | B | A |
| 13 | Pt—5Rh—20Ir—1Ni | B | B | B | A | B | A |
| 14 | Pt—3Rh—10Ir—1Ni | F | B | B | A | B | C |
| 15 | Pt—20Rh—1Re—1Ni | A | C | C | B | B | C |
| 16 | Pt—20Rh—1Ru—1Ni | A | C | C | B | B | C |
| 17 | Pt—20Rh—1Ir—1Ni | A | C | B | B | B | B |
| 18 | Pt—20Rh—5Ir—1Ni | A | B | B | B | B | A |
| 19 | Pt—20Rh—5Re—1Ni | A | C | B | B | B | B |
| 20 | Pt—20Rh—5Ru—1Ni | A | C | B | B | B | B |
| 21 | Pt—20Rh—20Ir—1Ni | A | B | B | B | B | A |
| 22 | Pt—20Rh—25Ir—1Ni | F | B | C | B | C | F |
| 23 | Pt—20Rh—10Ir—0.2Ni | A | B | C | B | B | B |
| 24 | Pt—20Rh—10Ir—0.5Ni | A | B | B | B | B | A |
| 25 | Pt—20Rh—10Ir—1.5Ni | A | B | A | B | B | A |
| 26 | Pt—20Rh—10Ru—2Ni | A | B | A | B | C | A |
| 27 | Pt—20Rh—10Ru—3Ni | A | C | A | B | C | B |
| 28 | Pt—20Rh—10Ru—3.5Ni | A | F | A | B | F | F |
| 29 | Pt—20Rh—10Ir—1Ni—1.5$Y_2O_3$ | A | B | B | B | B | A |
| 30 | Pt—20Rh—10Ir—1Ni—1.5$La_2O_3$ | A | B | B | B | B | A |
| 31 | Pt—20Rh—5Ir—5Re—1Ni | A | B | B | B | B | A |
| 32 | Pt—20Rh—5Ir—5Ru—1Ni | A | B | B | B | B | A |
| 33 | Pt—20Rh—5Ru—5Re—1Ni | A | B | B | B | B | A |
| 34 | Pt—20Rh—10Re—1Ni | A | B | B | B | B | A |

As verified by the respective evaluation tests, the results of Sample No. 1 show that weldability is inferior when the noble metal tip does not contain Ni. The results of Sample Nos. 2 and 3 show that spark consumption resistance is inferior when the noble metal tip does not contain "X" (one or a combination of two or more of Ir, Re and Ru). Further, Sample Nos. 3 to 5 show that a noble metal tip containing Pt as a main component and one and only one of Rh, "X" and Ni is not effective (comprehensive evaluation of "F").

Next, the optimum Rh content can be verified from the results of Sample Nos. 6 to 10, 12 and 14. Sample Nos. 6 and 7 show that grain growth can not be suppressed when the Rh content exceeds 40 wt %, the results of Sample Nos. 12 and 14 show that oxidation and volatilization of Ir can not be suppressed when the Rh content is less than 5 wt %. Specifically, when the Rh content is 5 wt % or more and 40 wt % or less, oxidation resistance is improved while grain growth is suppressed. The results of Sample Nos. 8 to 10 show that suppression of grain growth and improvement of oxidation resistance are enhanced when the Rh content is set so as to be 10 wt % or more and 30 wt % or less. Especially, the present inventors found that grain growth could be suppressed further effectively when the Rh content is set to 20 wt % or less.

In Sample Nos. 11 to 13, 17, 18, 21 and 22, the optimum Ir content was verified. The results of Sample Nos. 17, 18, 21 and 22 show that the effect of spark consumption resistance decreases when the Ir content is decreased. The results of Sample No. 2 show that spark consumption resistance deteriorates when the noble metal tip does not contain Ir. Therefore, the present inventors found that it si preferable to incorporate 1 wt % or more of Ir in practical use. It can also be seen that an Ir content of 5 wt % or more is more preferable for improving spark consumption resistance. On the other hand, the results of Sample Nos. 21 and 22 show that oxidation resistance deteriorates when the Ir content exceeds 20 wt %. Namely, the Ir content was found to be preferably 1 wt % or more and 20 wt % or less in practical use, and more preferably 5 wt % or more and 20 wt % or less. When the Rh content of Sample Nos. 11 to 13 was decreased to 5 wt % to increase sensitivity to oxidation resistance by relatively increasing the Ir content, it was found that oxidation resistance could be further improved while maintaining the effect of suppressing grain growth when the Ir content is 8 wt % or less. When comparisons between Sample Nos. 15 to 17, and comparisons between Sample Nos. 18 to 20 were respectively made, it was found that preferable results could be obtained even if "X" was Re or Ru instead of Ir when the total contents are within the above prescribed range, however, more preferable results can be obtained when "X" is Ir.

Next, the optimum Ni content was evaluated in reference to Sample Nos. 23 to 28. The present inventors found that weldability was inferior when the Ni content is less than 0.2 wt % based on Sample Nos. 23 and 24, and that problems occurred in both spark consumption resistance and workability when the Ni content exceeded 3 wt % based on Sample Nos. 27 and 28. Specifically, the test results show that sufficient performance can be obtained when the Ni content is 0.2 wt % or more and 3 wt % or less. Further, it can be seen that weldability is improved when the Ni content is 0.5 wt % or more based on Sample Nos. 24 to 26, and that spark consumption is improved when the Ni content is 2 wt % or less, which constitutes a preferred range. Especially, the present inventors found that an Ni content of 1.5 wt % or more is preferred because further improvement of weldability can be achieved.

As can be seen from the test results of Sample Nos. 29 and 30, an addition of a rare earth oxide to the Pt—Rh—X—Ni alloy is also effective.

In consideration of Sample No. 9 (Pr-20Rh-10Ir-1Ni) which exhibited preferable results in the respective evaluation tests, Sample Nos. 31 to 34 were also prepared and evaluated in which the combination of components constituting "X" was varied without changing its overall content of 10 wt % (namely, one or a combination of two or more of Ir, Re and Ru). All of these samples exhibited preferable results.

It goes without saying that various kinds of modifications are possible in the invention. For example, the noble metal tips 90, 91 were welded to the center electrode 20 or to the ground electrode 30 by resistance welding, however, the noble metal tip can be welded by laser welding. The noble metal tip 90 of the embodiment had a columnar shape, however, it can also have a rectangular-columnar shape, a pyramidal shape, or a conical shape, and also a cross-sectional convex shape having a large diameter part and a small diameter part. The noble metal tip can also assume a thin plate shape. Namely, various modifications of the invention are possible, regardless of the shape of the noble metal tip. As to the composition of the noble metal tip, various samples were prepared and evaluated in which one of Ir, Re and Ru as "X" was added or in which two of Ir, Re and Ru were arbitraily added. However, all three of Ir, Re and Ru can be present. Also in the embodiment, the noble metal tip 90 was welded to the center electrode 20 and the noble metal tip 91 was welded to the ground electrode 30. However, the noble metal tip may be bonded to only one or the other of the electrodes, and the invention is not limited to an embodiment in which both noble metal tips 90, 91 are bonded to the center electrode 20 and the ground electrode 30, respectively.

Needless to say, matters not directly related to the spark discharge can be modified suitably. For example, the use of talc is optional and the particular method of crimping may be freely selected. Furthermore, the corrugation formed at the insulator is not always necessary.

The invention is suitably applied to a spark plug in which a noble metal tip is used for an electrode executing a spark discharge.

This application is based on Japanese Patent Application JP 2004-381527, filed Dec. 28, 2004, the entire content of which is hereby incorporated by reference, the same as if set forth at length.

What is claimed is:

1. A spark plug comprising:

a center electrode;

an insulator having an axial hole extending in an axial direction of said center electrode, holding said center electrode inside said axial hole;

a metal shell surrounding said insulator to hold said insulator therein;

a ground electrode including a first end portion bonded to said metal shell and a second end portion opposed to said center electrode; and a noble metal tip bonded to at least one of a front-end portion of said center electrode and said second end portion of said ground electrode, wherein said noble metal tip comprises:

from 5 to 40 wt % of Rh;

from 5 to 20 wt % of at least one of Ir, Re and Ru;

from 0.2 to 3 wt % of Ni; and from 59 to 86 wt % of Pt.

2. The spark plug as claimed in claim 1, wherein said noble metal tip comprises from 10 to 30 wt % of Rh.

3. The spark plug as claimed in claim 2, wherein said noble metal tip comprises 20 wt % or less of Rh.

4. The spark plug as claimed in claim 1, wherein said noble metal tip comprises from 5 to 20 wt % of Ir.

5. The spark plug as claimed in claim 4, wherein said noble metal tip comprises 8 wt % or less of Ir.

6. The spark plug as claimed in claim 1, wherein said noble metal tip comprises from 0.5 to 2 wt % of Ni.

7. The spark plug as claimed in claim 6, wherein said noble metal tip comprises 1.5 wt % or more of Ni.

8. The spark plug as claimed in claim 1, wherein said noble metal tip further comprises a rare earth oxide.

9. A spark plug comprising:

a center electrode;

an insulator having an axial hole extending in an axial direction of said center electrode, holding said center electrode inside said axial hole;

a metal shell surrounding said insulator to hold said insulator therein;

a ground electrode including a first end portion bonded to said metal shell and a second end portion opposed to said center electrode; and a noble metal tip bonded to at least one of a front-end portion of said center electrode and said second end portion of said ground electrode, wherein said noble metal tip comprises:

from 5 to 40 wt % of Rh;

from ito 20 wt % of Re;

from 0.2 to 3 wt % of Ni; and 37 wt % or more of Pt.

* * * * *